US005402162A

United States Patent [19]

Fusting et al.

[11] Patent Number: 5,402,162

[45] **Date of Patent: * Mar. 28, 1995**

[54] INTEGRATED MULTI-COLOR INK JET PRINTHEAD

[75] Inventors: Daniel R. Fusting, Spring; John R. Pies; David B. Wallace, both of Dallas; Donald J. Hayes, Plano, all of Tex.

[73] Assignee: Compaq Computer Corporation, Houston, Tex.

[ * ] Notice: The portion of the term of this patent subsequent to Aug. 10, 2010 has been disclaimed.

[21] Appl. No.: 66,395

[22] Filed: May 20, 1993

Related U.S. Application Data

[63] Continuation-in-part of Ser. No. 748,220, Aug. 16, 1991, Pat. No. 5,235,352.

[51] Int. Cl.[6] ..... B41J 2/21

[52] U.S. Cl. ..... 347/43

[58] Field of Search ..... 346/140 R; 347/43, 69, 347/71

[56] References Cited

U.S. PATENT DOCUMENTS

| | | | |
|---|---|---|---|
| 3,857,049 | 12/1974 | Zoltan | 310/8.1 |
| 4,521,788 | 6/1985 | Kimura et al. | 346/140 R |
| 4,536,097 | 8/1985 | Nilsson | 400/126 |
| 4,584,590 | 4/1986 | Fischbeck et al. | 346/140 R |
| 4,814,786 | 3/1989 | Hoisington et al. | 346/140 R X |
| 4,825,227 | 4/1989 | Fischbeck et al. | 346/1.1 |
| 4,879,568 | 11/1989 | Bartky et al. | 346/140 R |
| 4,887,100 | 12/1989 | Michaelis et al. | 346/140 R |
| 4,889,181 | 2/1990 | Hawkins et al. | 347/63 |
| 4,963,882 | 10/1990 | Hickman | 346/1.1 |
| 4,965,595 | 10/1990 | Yoshimura | 346/140 R |
| 5,016,028 | 5/1991 | Temple | 346/140 R |
| 5,189,437 | 2/1993 | Michaelis et al. | 346/140 R X |
| 5,235,352 | 8/1993 | Pies et al. | 346/140 R |

FOREIGN PATENT DOCUMENTS

| | | | |
|---|---|---|---|
| 0364136 | 4/1990 | European Pat. Off. | B41J 2/045 |
| 0401575 | 5/1990 | European Pat. Off. . | |
| 0402172 | 12/1990 | European Pat. Off. | B41J 2/045 |
| 0485241 | 5/1992 | European Pat. Off. | B41J 2/045 |
| 0518700 | 6/1992 | European Pat. Off. . | |
| 3820082 | 12/1988 | Germany . | |
| 58-05273 | 1/1983 | Japan . | |

OTHER PUBLICATIONS

Wallace, David B., entitled "A Method of Characteristic Model of a Drop-on-Demand Ink-Jet Device Using an Integral Method Drop Formation Model", 89-*WA/-FE*-4 (1989).

Tsao, C. S., entitled "Drop-on-Demand Ink Jet Nozzle Array with Two Nozzles/Piezoelectric Crystal", *IBM Technical Disclosure Bulletin*, vol. 23 No. 10 (Mar. 1981).

*Primary Examiner*—Benjamin R. Fuller
*Assistant Examiner*—Alrick Bobb
*Attorney, Agent, or Firm*—Konneker Bush Hitt & Chwang

[57] ABSTRACT

An integrated multi-color drop-on-demand type ink jet printhead. The printhead includes a main body portion and a plurality of generally parallel, longitudinally extending ink-carrying channels arranged into at least two channel arrays. A manifold corresponding to each of the at least two channel arrays and in communication with each of the ink-carrying channels of the corresponding array is formed in the main body portion. Ink is supplied to each of the at least two channel arrays from a corresponding ink source, each of which is filled with a different color of ink.

16 Claims, 3 Drawing Sheets

INTEGRATED MULTI-COLOR INK JET PRINTHEAD

CROSS REFERENCE TO RELATED APPLICATION

This application is a continuation-in-part of co-pending U.S. patent application Ser. No. 07/748,220, filed Aug. 16, 1991, entitled "High Density Ink Jet Printhead", U.S. Pat. No. 5,235,352 assigned to the Assignee of the present application and hereby incorporated by reference as if reproduced in its entirety.

BACKGROUND OF THE INVENTION

1. Field of the Invention

The present invention generally relates to ink jet printhead apparatus and, more particularly, to an integrated multi-color drop-on-demand type ink jet printhead having longitudinally extending sidewall actuators.

2. Description of Related Art

Ink jet printing systems use the ejection of tiny droplets of ink to produce an image. The devices produce highly reproducible and controllable droplets, so that a droplet may be printed at a location specified by digitally stored image data. Most ink jet printing systems commercially available may be generally classified as either a "continuous jet" type ink jet printing system where droplets are continuously ejected from the printhead and either directed to or away from the paper depending on the desired image to be produced or as a "drop-on-demand" type ink jet printing system where droplets are ejected from the printhead in response to a specific command related to the image to be produced.

In drop-on-demand type ink jet printing systems, a volumetric change in the fluid is induced by the application of a voltage pulse to a piezoelectric material which is directly or indirectly coupled to the fluid. This volumetric change causes pressure/velocity transients to occur in the fluid and these are directed so as to produce a droplet that issues from an orifice. Recently, considerable interest has been directed to piezoelectric drop-on-demand type ink jet printheads which utilize sidewall actuators to impart droplet ejecting pressure pulses into the ink carrying channels. See, for example, U.S. Pat. Nos. 4,536,097 to Nilsson, 4,879,568 to Bartky et al., 4,887,100 to Michaelis et al. and 5,016,028 to Temple.

In Ser. No. 07/748,220, a U type drop-on-demand ink jet printhead was disclosed. The U type ink jet printhead included a lower body portion formed from an active piezoelectric material, a plurality of intermediate sections formed from an active piezoelectric material and an upper body portion formed from an inactive material. The lower body portion further included an upper side surface and a plurality of generally parallel spaced projections vertically projecting therefrom. Lower side surfaces of a plurality of intermediate sections were conductively mounted to top side surfaces of the lower body projections and the upper body portion was conductively mounted to upper side surfaces of the plurality of intermediate sections. In this manner, an ink jet printhead in which the lower body portion, the plurality of intermediate sections and the upper body portion defined a plurality of generally parallel, longitudinally extending ink ejecting channels was formed. For this ink jet printhead, the intermediate sections further defined first and second actuators and the projections and upper surface of the lower body portion defined a third actuator for each of the channels.

Like most other previously disclosed ink jet printing systems, the aforementioned configuration for an ink jet printhead provides for only one fluid system and is, therefore, capable of printing in only one color, most commonly, black. Color printing, however, requires multiple ink colors. For example, the use of four ink colors—the primary colors (yellow, magenta and cyan) and black-has proven quite satisfactory for producing color images. When manufacturing multiple color ink jet printheads, the most common approach has been to produce a printing system having a separate printhead for each ink color. However, there are numerous difficulties which arise when using multiple printheads in a single ink jet printing system.

Of primary concern is the requirement that the separate printheads must be properly aligned (or "registered") with each other in order for the printing system to properly produce color images. Furthermore, as ink jet printheads must be readily replaceable, permanently fastening the ink jet printheads after registration is not a feasible solution to this problem. Thus, in order to achieve registration of the separate printheads, some type of alignment capability which allows the printing system to determine the pitch and position of each printhead and make appropriate adjustments must be incorporated into the printing system. For example, it is contemplated that control software may be used to maintain proper registration of each printhead in such a printing system. However, not only is it difficult to ensure that such systems always accurately align the printheads, they add considerable cost and complexity to multi-color ink jet printing systems.

Furthermore, the use of multiple printheads in multi-color printing systems represents a significant obstacle to the production of smaller, less expensive multi-color ink jet printers. Each printhead is an independent system which requires its own transport, ink supply and actuation mechanisms. Thus, there are numerous redundant systems in a multiple printhead multi-color ink jet printer which, due to the independent nature of each printhead, resists integration. As a result, each printhead demands a significant amount of space, thereby impeding the successful construction of a compact, multi-color ink jet printhead.

It is, therefore, an object of this invention to provide an ink jet printhead which integrates multiple fluid systems in a single assembly, thereby permitting the manufacture of a multi-color ink jet printhead.

SUMMARY OF THE INVENTION

In one embodiment, the present invention is of an integrated multi-color drop-on-demand type ink jet printhead having a main body portion and a plurality of generally parallel, longitudinally extending ink-carrying channels arranged into at least two channel arrays. A manifold corresponding to each of the at least two channel arrays and in communication with each of the ink-carrying channels of the corresponding array is formed in the main body portion. Transport means are used to provide colored ink to each of the at least two channel arrays from a corresponding ink source, each of which is filled with a different color of ink.

In one aspect thereof, the main body portion is comprised of a lower body portion having a top side surface and a plurality of longitudinally extending, generally parallel grooves extending downwardly therefrom and an upper body portion having a bottom side surface. By mounting the bottom side surface of the upper body portion to the top side surface of the lower body portion, the plurality of ink-carrying channels are formed. In a further aspect, each of the at least two manifolds are formed in the upper body portion such that, when the lower and upper body portions are mounted together, the manifolds are placed into communication with the ink-carrying channels of the corresponding channel array. In another aspect, an internal conduit having a first opening in communication with one of the manifolds and a second opening interconnected with one of the ink supplies via a corresponding external conduit is formed in the upper body portion. Preferably, four ink sources for respectively providing black, yellow, magenta and cyan colored ink to first, second, third and fourth channel arrays should be provided.

In another embodiment, the present invention is of an integrated multi-color drop-on-demand type ink jet printhead having a lower body portion formed from an active piezoelectric material and having a plurality of generally parallel spaced projections projecting vertically from an upper side thereof. A bottom side surface of a corresponding intermediate section formed from an active piezoelectric material is conductively mounted to a top side surface of each of the plurality of projections and a bottom side surface of an upper body portion is conductively mounted to a top side surface of each of the intermediate sections. At least two manifolds are formed in the upper body portion such that, when the upper body portion is mounted to the intermediate sections, a plurality of generally parallel, longitudinally extending ink-carrying channels, each having first, second and third actuators and arranged into at least two channel arrays, are formed. In turn, each of the channel arrays is in communication with a corresponding one of the manifolds. At least two sources of colored ink, each of which is filled with a different color of ink, are connect with the ink jet printhead to supply ink to a corresponding one of the at least two channel arrays.

BRIEF DESCRIPTION OF THE DRAWING

The invention will be more clearly understood and its numerous objects and advantages will become apparent to those skilled in the art by reference to the accompanying drawing in which.

DETAILED DESCRIPTION

Figure 1:
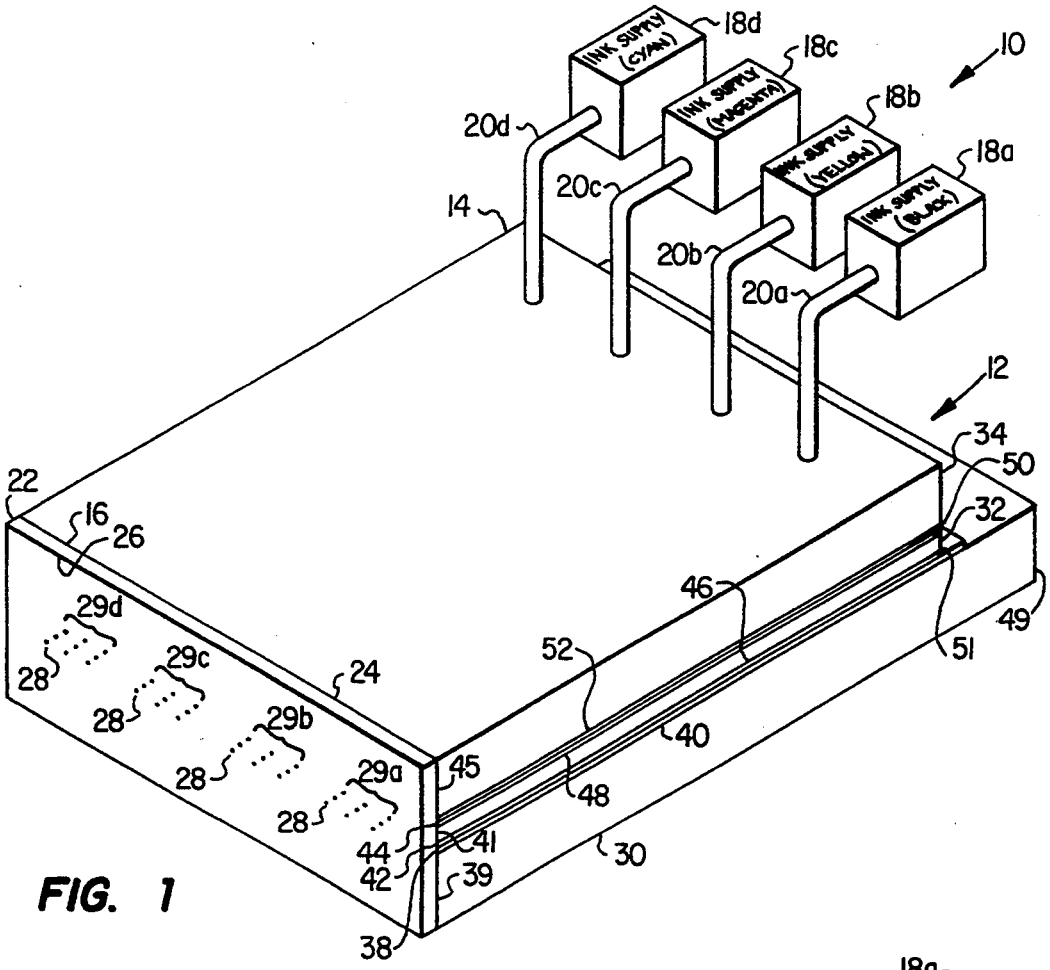
FIG. 1 is a perspective view of an integrated multi-color ink jet printhead constructed in accordance with the teachings of the present invention.
Figure 3:
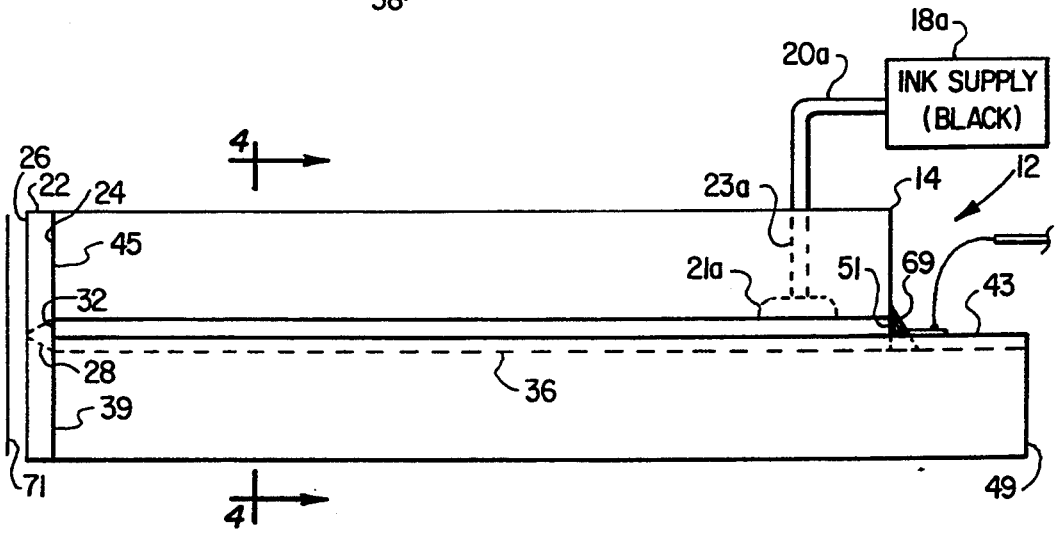
FIG. 3 is a side view of the integrated color ink jet printhead of FIG. 1.

Referring first to FIG. 1, a drop-on-demand type multi-color ink jet printer 10 constructed in accordance with the teachings of the present invention may now be seen. The multi-color ink jet printer 10 includes an integrated multi-color ink jet printhead 12 provided with a main body portion 14 having a plurality of ink carrying channels (not visible in FIG. 1) longitudinally extending therethrough. Typically, each of the ink carrying channels extend from a first end located within the main body portion 14 and terminate at an opening along a front side surface 16 of the main body portion 14. Preferably, the ink carrying channels should be generally parallel to each other along their entire length. As will be described in greater detail below, the ink carrying channels longitudinally extending through the main body portion 14 should be arranged in plural channel arrays, one for each color of ink to be ejected by the multi-color ink jet printhead 14, each separated from adjacent channel arrays by a separation distance sufficient to prevent cross-contamination of the various inks. For example, it is contemplated that four channel arrays, one for each of the ink colors (black, yellow, magenta and cyan) to be ejected by the multi-color ink jet printhead, each separated from adjacent channel arrays by about 2.2 mm., will be suitable for use.

The ink carrying channels of each channel array is supplied by a corresponding ink supply **18*a*, 18*b*, 18*c*, 18*d* via an external conduit 20*a*, 20*b*, 20*c*, 20*d*. A different color ink is stored in each of the ink supplies 18*a*, 18*b*, 18*c*, 18*d*. For example, the ink supply 18*a* contains black ink, the ink supply 18*b* contains yellow ink, the ink supply 18*c* contains magenta ink and the ink supply 18*d* contains cyan ink. It should be noted, however, that while four structurally independent ink supplies 18*a–d* have been schematically illustrated in FIG. 1, it is specifically contemplated that the ink supplies 18*a–d* could be integrated into a single ink supply having separate chambers for storing each color of ink. In such a configuration, it is further contemplated that, as they extend away from the multi-color ink jet printhead 12, the external conduits 20*a–d* would be physically tied together before again separating for interconnection with a respective access opening of one of the chambers of the integrated ink supply. Further details as to how the each ink supply 18*a*, 18*b*, 18*c*, 18*d*** supplies a respective color of ink to each of the channel arrays shall be described in detail later.

Continuing to refer to FIG. 1, the integrated color ink jet printhead 12 further includes a cover plate 22 having a back side surface 24 fixedly secured to the front side surface 16 of the main body portion 14, a front side surface 26 and a plurality of tapered orifices 28 extending therethrough. The tapered orifices 28 are arranged in four orifice arrays **29*a*, 29*b*, 29*c* and 29*d* and the cover plate secured to the main body portion 14 such that each orifice in the orifice arrays 29*a*, 29*b*, 29*c*, 29*d* is in communication with one of the ink carrying channels of the corresponding channel array. While it is contemplated that each orifice array 29*a–d* would contain eighteen orifices 28, for ease of illustration, only nine such orifices 28 are shown in FIG. 1 for each orifice array 29*a–d*. Preferably, the cover plate 22 should be formed of polyamide or another suitable material and fixedly secured to the front side surface 16 such that each orifice 28** is located in the general center of the corresponding one of the ink carrying channels.

Figure 4:
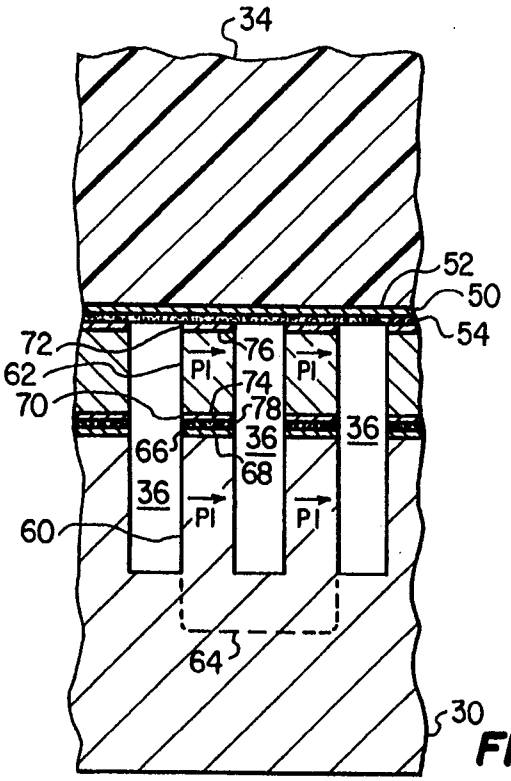
FIG. 4 is an enlarged partial cross-sectional view taken along lines 4—4 of FIG. 3.

Continuing to refer to FIG. 1, the main body portion 14 will now be described in greater detail. The main body portion 14 is comprised of a lower body portion 30 formed of an active piezoelectric material, for example, lead zirconate titante (or "PZT"), poled in direction P1 (see FIG. 4) and having a layer 38 of a conductive material, for example, metal, formed on a top side surface 40 thereof, an intermediate body portion 32, also formed of an active piezoelectric material, poled in direction P1 (again, see FIG. 4) and having layers 42, 44 of a conductive material formed on bottom and top side surfaces 46, 48, respectively, and an upper body portion 34 formed of an inactive material, for example an unpoled piezoelectric or ceramic material, and having a layer 50 of a conductive material formed on a lower side surface 52 thereof.

Figure 2:
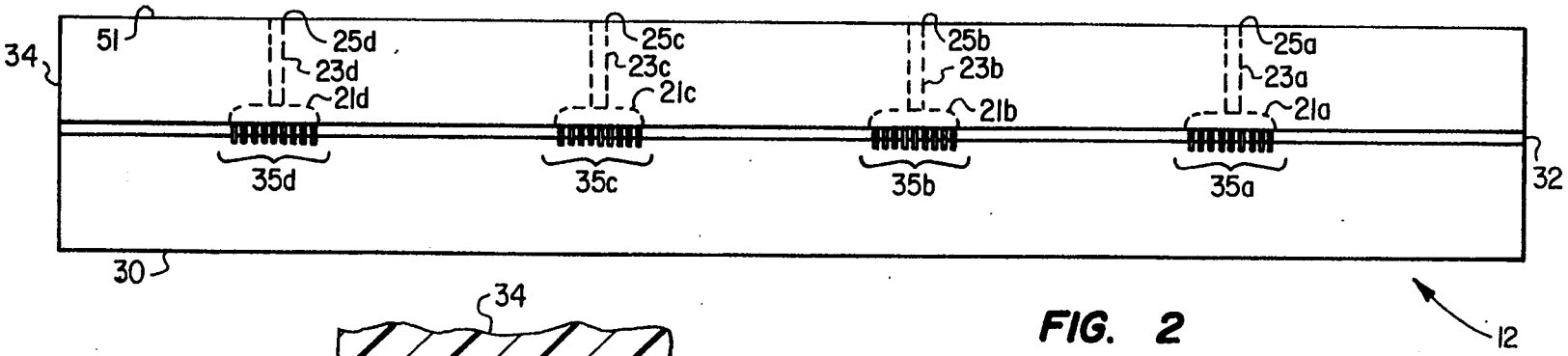
FIG. 2 is a front view of the integrated multi-color ink jet printhead of FIG. 1 with the cover plate removed.

Referring next to FIG. 2, the channel arrays 35*a*, 35*b*, 35*c* and 35*d* may now be seen. Each channel array is comprised of a plurality of generally parallel, longitudinally extending ink carrying channels 36. While the number of channels 36 in a channel array 35*a–d* may be varied depending on the particular dimensions of the integrated multi-color ink jet printhead 12, it is contemplated that four channel arrays 35*a–d*, each comprised of eighteen ink carrying channels 36 separated from adjacent channels by about 0.2 mm. would be suitable for the purposes contemplated herein. For each channel array 35*a*, 35*b*, 35*c*, 35*d*, a corresponding manifold 21*a*, 21*b*, 21*c*, 21*d* is formed in the upper body portion 34, for example, using a conventional grooving process. Each manifold 21*a*, 21*b*, 21*c*, 21*d* is formed across a portion of the lower side surface 52 of the upper body portion 34 in a direction generally normal to the corresponding channel array 35*a–d* selected such that, when the upper body portion 34 is later mounted to the intermediate body portion 32 in the manner described below, the manifolds 21*a*, 21*b*, 21*c*, 21*d* is in communication with each channel 36 of the corresponding channel array 35*a*, 35*b*, 35*c*, 35*d*. Also formed in the upper body portion 34 are internal conduit 23*a*, 23*b*, 23*c*, 23*d*, each of which vertically extends between the top and bottom side surfaces 51, 52 of the upper body portion 34, is in communication with the corresponding manifold 21*a*, 21*b*, 21*c*, 21*d* on one end thereof and has an opening 25*a*, 25*b*, 25*c*, 25*d* along the top side surface 51 of the upper body portion 34 on the other end. The internal conduits 23*a–d* may be formed using a conventional drilling process. The external conduits 20*a*, 20*b*, 20*c*, 20*d* are mated with the corresponding internal conduits 23*a*, 23*b*, 23*c*, 23*d*, for example, by inserting one end of each of the external conduits into the corresponding internal conduit and securing it therein. In this manner, when droplets of various colors of ink are ejected from the channels 36 of the various channel arrays 35*a–d*, additional ink from the corresponding ink supplies 18*a–d* is drawn into those channels 36 via the manifolds 21*a–d*, the vertical conduits 23*a–d* and the external conduits 20*a–d*, respectively.

While the number and dimensions of the manifolds 21*a–d* and the internal conduits 23*a–d* will vary depending on the separation between the channels 36, the number of channels 36 in each channel array 35*a–d* and the number of channel arrays 35*a–d* (or colors) in the multicolor ink jet printhead 12, manifolds 21*a–d* having a length of about 4.2 mm., a width of about 1.3 mm. and separated from adjacent manifolds by about 2.2 mm. would be suitable for the purposes contemplated herein. It should be further noted that while the manifolds 21*a–d* are shown in a generally oblong shape, it is specifically contemplated that the particular shape of the manifolds 21*a–d* may be formed in various other shapes not illustrated herein without departing from the scope of the present invention. Furthermore, while the position of each internal conduits 23*a–d* may be varied relative to the corresponding manifold 21*a–d*, it is preferred that the internal conduits 23*a–d* be located in the general center of the corresponding manifold 21*a–d*. As before, while various shapes and dimensions for the internal conduits 23*a–d* would be suitable, a generally tubular conduit having a diameter of about 1.3 mm is suitable for the uses contemplated herein. Finally, while the manifolds 21*a–d* and internal conduits 23*a–d* may be located anywhere along the upper body portion 34, for ease of interconnection with the corresponding ink supplies 18*a–d*, it is preferred that the manifolds 21*a–d* and internal conduits 23*a–d* be located in the rear part of the upper body portion 24.

Referring next to FIGS. 1, 2, 4 and 5, the manufacture of the integrated multi-color ink jet printhead 12 will now be described in greater detail. To manufacture the integrated multi-color ink jet printhead 12, a layer of conductive adhesive (not shown) is applied to the conductive layer 38 formed on the upper side surface 40 of the lower body portion 30. Front side surfaces 39, 41 of the lower and intermediate body portions 30, 32, respectively, are then aligned and the lower and intermediate body portions 30, 32 mated and bonded with each other. As may be best seen in FIG. 5, the lower body portion 30 continues to extend rearwardly past the intermediate body portion 32, thereby providing a so-called "back porch" 43 for the integrated multi,color ink jet printhead 12 where electrical interconnections between the actuation system for the channel 36 of the channels arrays 35*a–d* for the integrated multi-color ink jet printhead 12 to be more fully described below and a controller (not shown) is provided. To better facilitate this electrical interconnection, it is preferred that the conductive layer 38 formed on the top side surface 40 of the lower body portion 30 extend only partway along the back porch 43. This may be accomplished by covering a portion of the back porch 43 with a thin layer of an insulative material, for example, teflon, before forming the conductive layer 38 on the top side surface 40, most commonly, using a conventional deposition process.

After the lower body portion 30 and the intermediate body portion 32 are conductively mounted together, a machining process is then utilized to form the channels 36, grouped together as channel arrays 35*a–d* for the integrated multi-color ink jet printhead 12. As may be seen in FIG. 5, a series of longitudinally extending, substantially parallel channels 36 are formed by machining grooves which extend through the intermediate body portion 32 and the lower body portion 30. Preferably, the machining process is performed such that each channel 36 formed thereby extends downwardly such that portions of the conductive layer 44, the intermediate body portion 32, the conductive layer 42, the conductive adhesive layer between conductive layers 42 and 38 (not shown), the conductive layer 38 and the lower body portion 30 are removed. It is further preferred that the machining process be performed such that the grooves formed thereby longitudinally extend from the front side surfaces 39, 41 to rear side surfaces 49, 51 of the lower and intermediate body portions 30, 32, respectively.

The manifolds 21*a–d* and vertical conduits 23*a–d* are then formed in the upper body portion 34 in the manner previously described. A layer 54 of conductive adhesive is then applied to the remaining conductive layer 50 not removed during the formation of the manifolds 21*a–d*, for example, using a patterning process. A front side surface 45 of the upper body portion 34 is then aligned with the front side surface 41 of the intermediate body portion 32 and the two conductively mounted together. An insulative composite material 69 is then used to form back walls for the channels 36 of the channel arrays 35*a–d* by closing the open ends of the channels 36 along the rear side surfaces 49, 51 of the lower and intermediate body portions 30, 32.

By forming grooves in the lower and intermediate body portions 30, 32 and mounting the upper body portion 34 to the grooved intermediate body portion 32 in this manner, a series of channels 36 which comprise the channel arrays 35*a–d* for the integrated color ink jet printhead 12 are formed. Each channel 36 formed in this manner is separated from an adjacent channel by a first sidewall portion 60 integrally formed with the lower body portion 32 and having a conductive strip 66 formed along a top side surface 68 of the sidewall portion 60 and a second sidewall portion 62 having conductive strips 70, 72 formed along bottom and top side surfaces 74, 76 of the second sidewall portion. The conductive strips 66 and 74 are bonded together by a strip 78 of conductive adhesive. Finally, each conductive strip 66 is electrically connected, for example, by a soldering process, along the back porch 43 to an electrical conductor 80 associated with a controller (not shown) and the conductive layer 50, which is electrically connected to the second sidewall portions 62 of every channel 36 of the channel arrays 35*a–d*, is connected to ground, thereby providing a common ground for the channel arrays 35*a–d*.

As more fully described in Ser. No. 07/748,220, each channel 36 has three actuators for imparting a pressure pulse into the channel. Two of these actuators are respectively comprised of the second sidewall portions 62 which partially define first and second sidewalls of the channel 36. The third (or "U-field") actuator 64 is comprised of the pair of first sidewall portions 60 which partially define the first and second sidewalls of the channel 36, respectively, and that portion of the lower body portion 30 which interconnects the pair of first sidewall actuator portions 60. Further details regarding how the actuators 62 and 64 impart pressure pulses to the channels 36 to cause the ejection of droplets of ink therefrom is set forth in greater detail in Ser. No. 07/748,220 and need not be discussed in greater detail here. Briefly, in order to impart droplet ejecting pressure pulse to a channel 36, a positive voltage is applied to the conductive strip 66 connecting the first and second sidewall portions 60, 62 on one side of the channel 36 while an equal magnitude negative voltage is applied to the conductive strip 66 connecting the first and second sidewall portions 60, 62 on the other side of the channel 36. After maintaining the preselected voltages for a predetermined time period, the voltages applied to the conductive strips 66 are reversed and held at the reverse voltage for the predetermined time period. This ink ejecting voltage waveform is further described in Ser. No. 08/060,294, filed May 10, 1993, entitled "Droplet Volume Modulation Techniques for an Ink Jet Printhead" and hereby incorporated by reference as if reproduced in its entirety.

Figure 5:
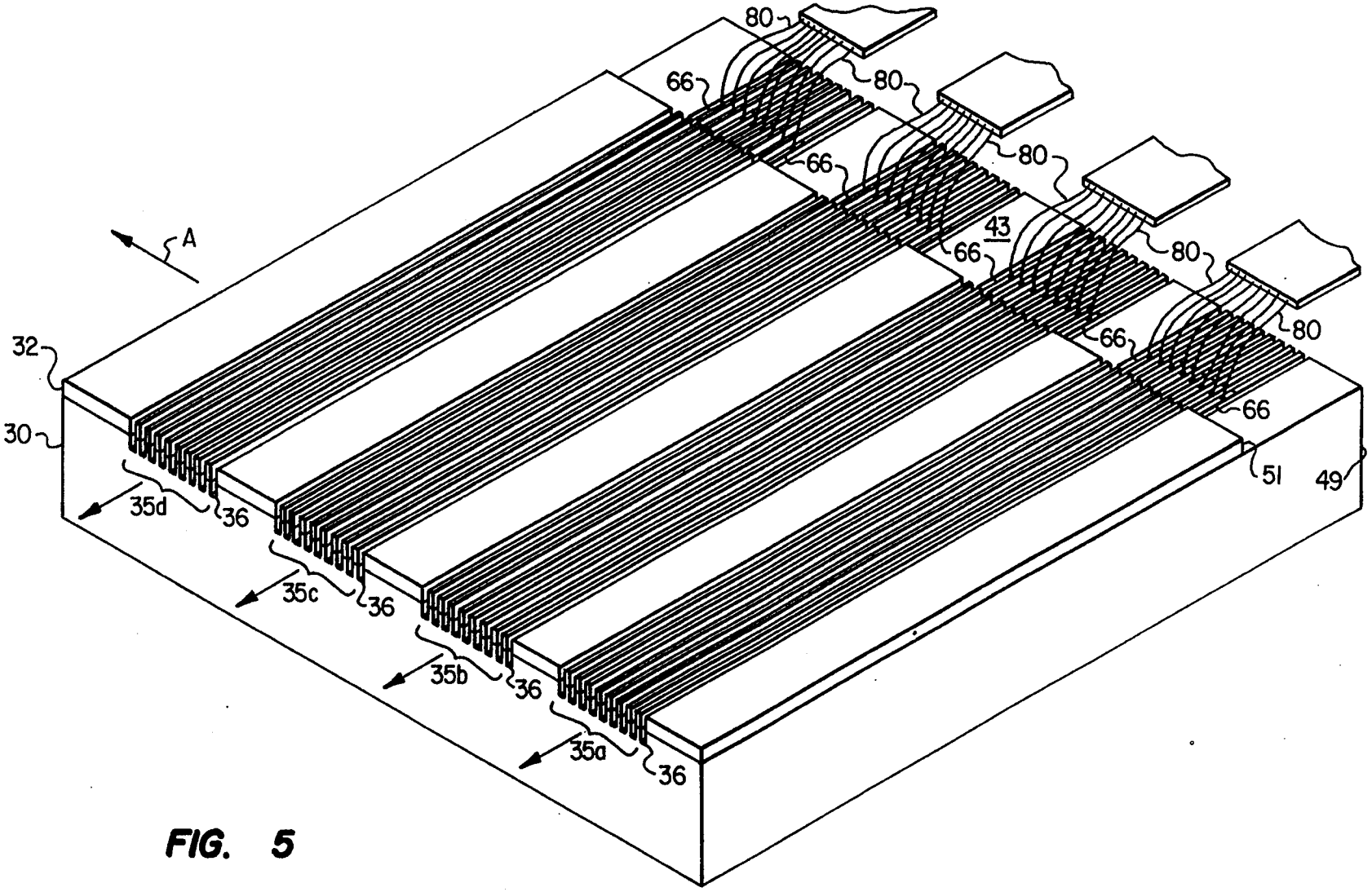
FIG. 5 is a perspective view of the integrated color ink jet printhead of FIG. 1 with the cover plate and upper body portions removed.

It should be noted that while FIG. 5 suggests that each channel array 35*a–d* corresponding to a color is electrically connected to a separate controller for that color, it is specifically contemplated that, in accordance with one aspect of the invention, a single controller may be used to control the ejection of droplets of ink from any one of the channel arrays 35*a–d*. Accordingly, when forming a full color image, the controller will actuate selected ones of the channels 36 from the various channel arrays 35*a–d* at desired times as the multi-color ink jet printhead 12 moves, relative to substrate 71, for example, a sheet of paper, in direction "A", by selectively applying voltage to the conductive strips 66 on either side of the selected channels must eject a droplet of ink. In response thereto, the selected channels will eject a droplet of the selected color of ink which strikes the substrate 71 at the desired location.

Thus, there has been described and illustrated herein, an ink jet printhead which incorporates multiple channel arrays, each configured for the selective ejection of a different color of ink therefrom. By providing the capability of printing multiple colors using a single ink jet printhead, a simple, relatively compact multi-color ink jet printhead which overcomes the problems associated with prior multi-color ink jet printing systems which utilized multiple single color printheads disadvantageously requiring repeated registration therebetween to ensure the proper formation of images thereby. By overcoming this disadvantage associated with prior ink jet system, the integrated multi-color ink jet printhead disclosed herein will be more reliable and produce color images with greater accuracy than prior multiple printhead color ink jet printing systems.

Those skilled in the art will recognize that many modifications and variations besides those specifically mentioned may be made in the techniques described herein without departing substantially from the concept of the present invention. Accordingly, it should be clearly understood that the form of the invention as described herein is exemplary only and is not intended as a limitation on the scope of the invention.

What is claimed is:

1. An integrated multi-color drop-on-demand type ink jet printhead, comprising:

a main body portion having a front side surface and a plurality of generally parallel ink-carrying channels longitudinally extending therethrough, each of said channels having an opening along said front side surface of said main body portion, said channels arranged into at least two channel arrays;

a manifold for each of said at least two channel arrays, each said manifold formed in said main body portion and in communication with each of said channels of a corresponding channel array;

a source of colored ink for each of said at least two channel arrays, each said ink source being filled with a different color of ink; and means for transporting ink from each ink source to a corresponding manifold;

wherein said main body portion further comprises:

a lower body portion of a first length, said lower body portion having a top side surface, a plurality of longitudinally extending, generally parallel grooves extending downwardly therefrom, and a front side surface;

an intermediate body portion of a second length shorter than said first length and formed of an active piezoelectric material, said intermediate body portion having a front side surface aligned with said front side surface of said lower body portion, a top side surface and a bottom side surface conductively mated with a first portion of said top side surface of said lower body portion, a second portion of said top side surface of said lower body portion remaining unmated;

an upper body portion having a bottom side surface conductively mated with said top side surface of said intermediate body portion; and means for electrical connection which extends from at least one first location along said first portion of said top side surface of said lower body portion to at least one second location along said second portion of said top side surface of said lower body portion;

and wherein application of a voltage to said electrical connection means causes a piezoelectric distortion of said intermediate body portion which imparts a pressure pulse to at least one of said plurality of ink-carrying channels.

2. An integrated multi-color drop-on-demand type ink jet printhead according to claim 1 wherein each manifold is formed in said upper body portion, each manifold being placed into communication with said ink-carrying channels of said corresponding channel array when said upper body portion is mounted to said lower body portion.

3. An integrated multi-color drop-on-demand type ink jet printhead according to claim 2 wherein each manifold is formed generally normal to said ink-carrying channels in communication therewith.

4. An integrated multi-color drop-on-demand type ink jet printhead according to claim 2 wherein said transport means further comprises:

an internal conduit for each manifold, each said internal conduit formed in said upper body portion and having a first opening in communication with a corresponding manifold and a second opening along an exterior surface of said upper body portion; and an external conduit for each internal conduit, each said external conduit having a first opening in communication with said corresponding source of colored ink and a second opening in communication with a corresponding internal conduit.

5. An integrated multi-color drop-on-demand type ink jet printhead according to claim 4 wherein said upper body portion further comprises a top side surface and wherein said second opening of each internal conduit is formed along said top side surface of said upper body portion.

6. An integrated multi-color drop-on-demand type ink jet printhead according to claim 5 further comprising first, second, third and fourth channel arrays, each having associated manifolds, internal conduits, external conduits and sources of colored ink, respectively.

7. An integrated multi-color drop-on-demand type ink jet printhead according to claim 6 wherein said first, second, third and fourth sources of colored ink further comprise sources of black, yellow, magenta and cyan colored ink, respectively.

8. An integrated multi-color drop-on-demand type ink jet printhead according to claim 1, wherein said electrical connection means further comprises a layer of conductive material secured to said top side surface of said lower body portion and said bottom side surface of said intermediate body portion, said layer of conductive material extending along at least part of said second portion of said top side surface.

9. An integrated multi-color drop-on-demand type ink jet printhead according to claim 1, wherein said intermediate body portion further comprises a rear side surface and wherein mating of said intermediate body portion and said lower body portion forms an open rear end for each of said plurality of ink-carrying channels, said ink jet printhead further comprising an insulative composite material deposited in each of said ink-carrying channels to close said open rear ends.

10. An integrated multi-color drop-on-demand type ink jet printhead according to claim 9, wherein said electrical connection means further comprises a layer of conductive material secured to said top side surface of said lower body portion and said bottom side surface of said intermediate body portion, said layer of conductive material passing through said insulative composite material and extending along at least part of said second portion of said top side surface.

11. An integrated multi-color drop-on-demand type ink jet printhead, comprising:

a lower body portion formed from an active piezoelectric material, said lower body portion having a back end surface, a front end surface, an upper side surface and a plurality of generally parallel spaced projections arranged into at least two arrays thereof, each of said projections having a top side surface, projecting vertically from said upper side surface and extending longitudinally along said lower body portion;

intermediate sections for each of said plurality of projections, each of said intermediate sections having an upper side surface and a lower side surface conductively mounted on said top side surface of a corresponding one of said plurality of lower body portion projections, each of said intermediate sections formed from an active piezoelectric material;

an upper body portion having a bottom side surface conductively mounted to said upper side surface of each of said plurality of intermediate sections, said upper body portion formed from an inactive material and having a manifold formed therein for each of said at least two arrays of projections;

said lower body portion, said plurality of intermediate sections and said upper body portion defining a plurality of generally parallel, longitudinally extending ink-carrying channels between said spaced projections extending from said back end surface to said front end surface and arranged into a channel array for each manifold, said manifold being placed into communication with said ink-carrying channels of a corresponding channel array when said lower side surface of said upper body portion is mounted to said top side surface of said intermediate sections;

said intermediate sections forming first and second actuators for each one of said plurality of ink-carrying channels and said projections of said lower body portion and said upper side surface of said lower body portion forming a third actuator for each one of said plurality of ink-carrying channels;

a source of colored ink for each of said at least two channel arrays, each said ink source being filled with a different color of ink; and means for transporting ink from each ink source to said corresponding manifold.

12. An integrated multi-color drop-on-demand type ink jet printhead according to claim 11 wherein each manifold is formed generally normal to said ink-carrying channels in communication therewith.

13. An integrated multi-color drop-on-demand type ink jet printhead according to claim 11 wherein said transport means further comprises:

an internal conduit for each manifold, each said internal conduit formed in said upper body portion and having a first opening in communication with a corresponding manifold and a second opening along an exterior surface of said upper body portion; and an external conduit for each internal conduit, each said external conduit having a first opening in communication with a corresponding source of colored ink and a second opening in communication with a corresponding internal conduit.

14. An integrated multi-color drop-on-demand type ink jet printhead according to claim 13 wherein said upper body portion further comprises a top side surface and wherein said second opening of each internal conduit is formed along said top side surface of said upper body portion.

15. An integrated multi-color drop-on-demand type ink jet printhead according to claim 14 further comprising first, second, third and fourth channel arrays, each having associated manifolds, internal conduits, external conduits and sources of colored ink, respectively.

16. An integrated multi-color drop-on-demand type ink let printhead according to claim 15 wherein said first, second, third and fourth sources of colored ink further comprise sources of black, yellow, magenta and cyan colored ink, respectively.

* * * * *